United States Patent [19]

Yost

[11] 4,083,320

[45] Apr. 11, 1978

[54] NON-BROACHING BOAT HULL

[76] Inventor: John V. Yost, 2233 Riverside Dr., Trenton, Mich. 48183

[21] Appl. No.: 684,173

[22] Filed: May 7, 1976

[51] Int. Cl.[2] ..... B63B 1/18

[52] U.S. Cl. ..... 114/271; 114/56; D12/62

[58] Field of Search ..... 114/56, 66.5 R, 271, 114/291; D12/62

[56] References Cited

U.S. PATENT DOCUMENTS

| | | | |
|---|---|---|---|
| 3,363,598 | 1/1968 | Mortrude | 114/56 X |
| 3,495,563 | 2/1970 | Reischmann | 114/66.5 R |

*Primary Examiner*—Allen N. Knowles
*Assistant Examiner*—Edward M. Wacyra
*Attorney, Agent, or Firm*—Clarence A. O'Brien; Harvey B. Jacobson

[57] ABSTRACT

A hull is provided including an aft transom and upstanding freeboard sides extending forwardly from the stern and terminating in a forward bow. The hull includes bottom structure having a central keel extending horizontally forward from the transom and curving upwardly at its forward end portion to form the aforementioned forward bow. The bottom structure includes opposite side deadrise surfaces extending outwardly from the keel and the deadrise surfaces decrease in width to a forward apex defined by the forward extremities of the deadrise surfaces. The forward end portions of the deadrise surfaces curve upwardly into the lower portion of the bow and the angle of the deadrise surfaces relative to transverse horizontal lines does not increase from the transom toward the aforementioned apex. Opposite side outer bottom surfaces extend between the remote marginal portions of the deadrise surfaces and the lower marginal portions of the freeboard sides. The outer bottom surfaces increase in width at least from the transom to the lowermost point of the upwardly curving bow and the angle of the outer bottom surfaces relative to transverse horizontal lines remains at least substantially constant from the transom forward to at least the lower portion of the upwardly curving bow. Further, the angle of the outer bottom surfaces relative to transverse horizontal lines is at least slightly greater than corresponding transverse portions of the adjacent deadrise surfaces.

13 Claims, 7 Drawing Figures

10
12
14
16
18
20
22
24
26
28
30
32
34
36
38
42
44
10'
12'
14'
16'
18'
20'
22'
24'
28'
30'
32'
36'
42'
15
13
11
9
7
5
3
1
0
1
2
3
4
5
6
7
8
9
10
11
12
13
14
15
16

NON-BROACHING BOAT HULL

BACKGROUND OF THE INVENTION

To provide a smooth ride in rough water, various hull constructions use a downwardly pointing V-bottom, at least at the keel line, which increases in inclination near the bow. The deep-V hull and the cathedral hull are of this type. Also catamarans, trimarans and other multihull craft often consist of two or more such hulls joined together.

However, when moving with the waves, these hulls fall off one wave and plow into the next where their sharply inclined bow surfaces act like a rudder around which they rotate or broach. Yet their wide amidship bottom surfaces still pound against oncoming waves.

Further, at high planing speeds, these hulls need to have their center of gravity substantially rearward of amidship in order to keep the bow up and reduce wetted area which reduces frictional drag, but such a rearward center of gravity causes excess bow rise at low speed.

Further if the angle of the V is not deep, these hulls tend to skid excessively in a turn.

Examples of various types of hulls designed to improve rough water performance and handling are disclosed in U.S. Pat. Nos. 1,729,446, 2,980,924, 3,117,544, 3,160,134, 3,203,389, 3,363,598, 3,547,064 and 3,763,810.

BRIEF DESCRIPTION OF THE INVENTION

The hull of the instant invention includes low angle deadrise or planing surfaces not increasing in inclination at the bow and freeboard surfaces with lower marginal edges forward of amidship terminating substantially above the waterline whereby there are no steeply inclined bow surfaces which may be submerged and cause broaching. Further, the low angle deadrise or planing surfaces are narrow at amidship in order to reduce pounding in rough water and reduce bow rise at low speeds. Still further, the instant invention includes outer bottom surfaces inclined more steeply than the planing surfaces in order to pound less in rough water, but inclined substantially less than vertical so as not to cause broaching. Still further, the intersection of the planing surfaces and the outer bottom surfaces acts like a keel and resists skidding during a turn.

The main object of this invention is to provide a boat hull construction having improved riding and handling characteristics in the areas of high speed operation over rough waters, high speed turning, low planing speeds and while experiencing conditions which normally tend to cause conventional V bottom hulls to broach.

Another object of this invention is to provide a boat hull construction of a configuration which lends itself well to manufacture from a plurality of materials including wood, aluminum and fiber glass.

Another important object of this invention is to provide a hull construction which also lends itself well to manufacture with either a pointed bow or a square bow.

A final object of this invention to be specifically enumerated herein is to provide an improved hull construction in accordance with the preceding objects and which will conform to conventional forms of manufacture, be of simple construction and safe in use so as to provide a device which will be economically feasible, long lasting and dependable in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

Figures 1, 3, 4, 6:
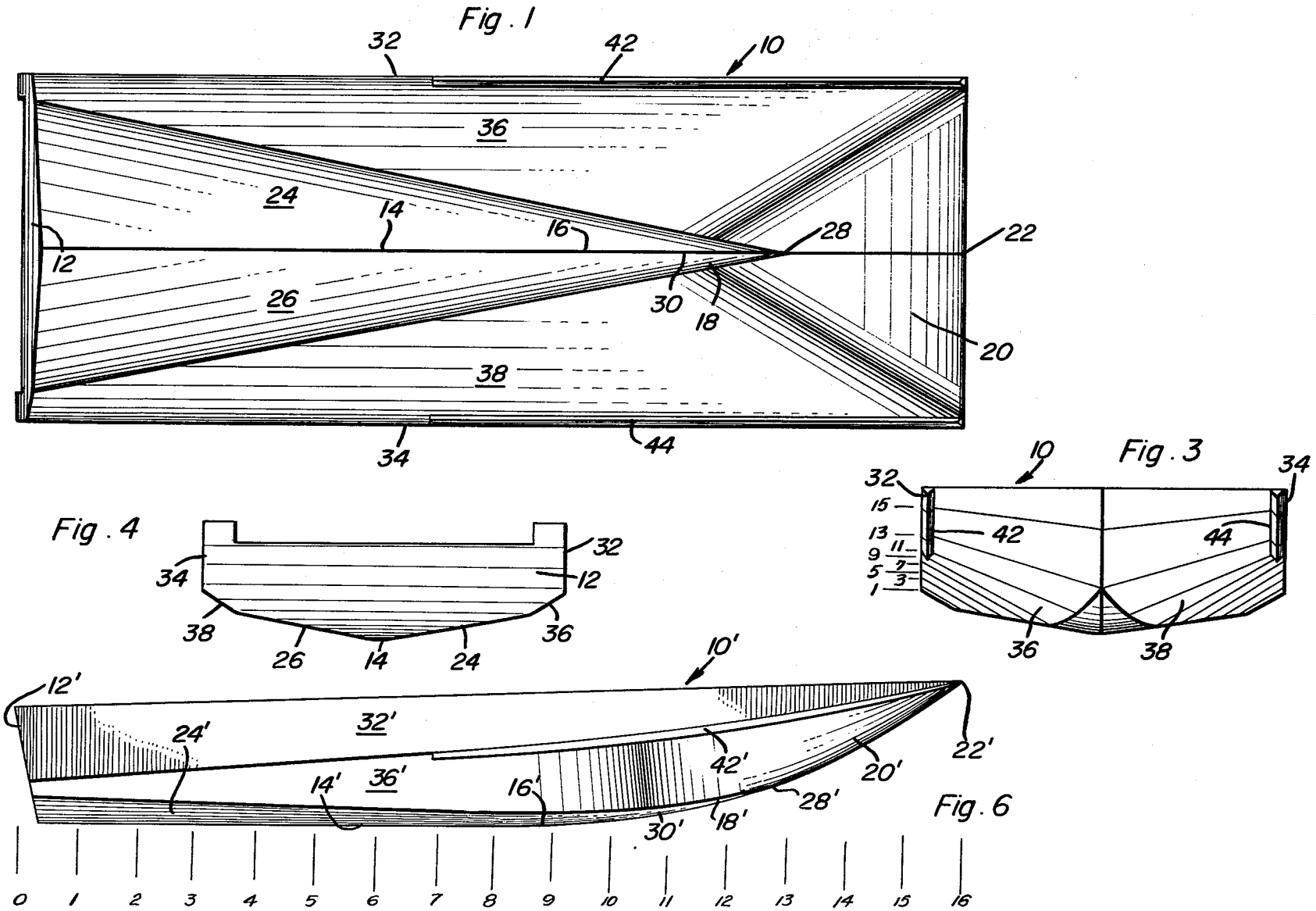
FIG. 1 is a bottom plan view of a hull of the square bow type constructed in accordance with the present invention.
FIG. 3 is a front view of the hull illustrated in FIGS. 1 and 2.
FIG. 4 is a rear elevational view of the hull illustrated in FIGS. 1, 2 and 3.
FIG. 6 is a side elevational view of the hull illustrated in FIG. 5.

Referring now more specifically to the drawings and to FIGS. 1 through 4 in particular, the first form of hull is referred to in general by the reference numeral 10. The hull 10 includes a transom 12 and a center keel 14 extending horizontally forwardly from the transom 12 to a point 16 and then curving upwardly as at 18 to define a forwardly and upwardly curving bow 20 terminating forwardly as at 22. A pair of wedge-shaped forwardly tapering opposite side deadrise or bottom planing surfaces 24 and 26 extend outwardly from the keel 14 and forwardly from the transom 12 to a forward apex 28. The deadrise or planing surfaces 24 and 26 are substantially longitudinally straight to a transverse vertical plane passing through the point 16 and then the remainder of the forward end portions thereof curve upwardly toward the apex 28 as at 30. The full 10 additionally includes substantially longitudinally straight and vertical freeboard sides 32 and 34 which extend forwardly from the transom 12 to the forward extremity of the bow 20 and also includes opposite side outer bottom surfaces 36 and 38 which extend between and interconnect the outer marginal portions of the deadrise or planing surfaces 24 and 26 and the lower marginal portions of the freeboard sides 32 and 34, the outer bottom surfaces 36 and 38 converging toward and being joined with each other at their forward end portions forward of the point 28 to complete the bow 20. Also, the hull 10 includes spray rails 42 and 44 which depend downwardly from the lower marginal portions of the freeboard sides 32 and 34 from the forward extremity of the bow 22 to a point spaced at least slightly rearwardly of a transverse vertical plane passing through the point 16.

Figure 7:
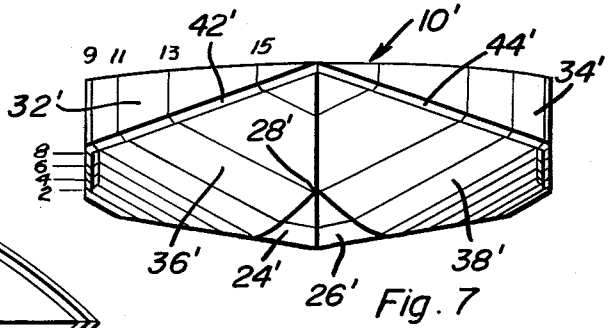
FIG. 7 is a front elevational view of the hull illustrated in FIGS. 5 and 6.
Figure 5:
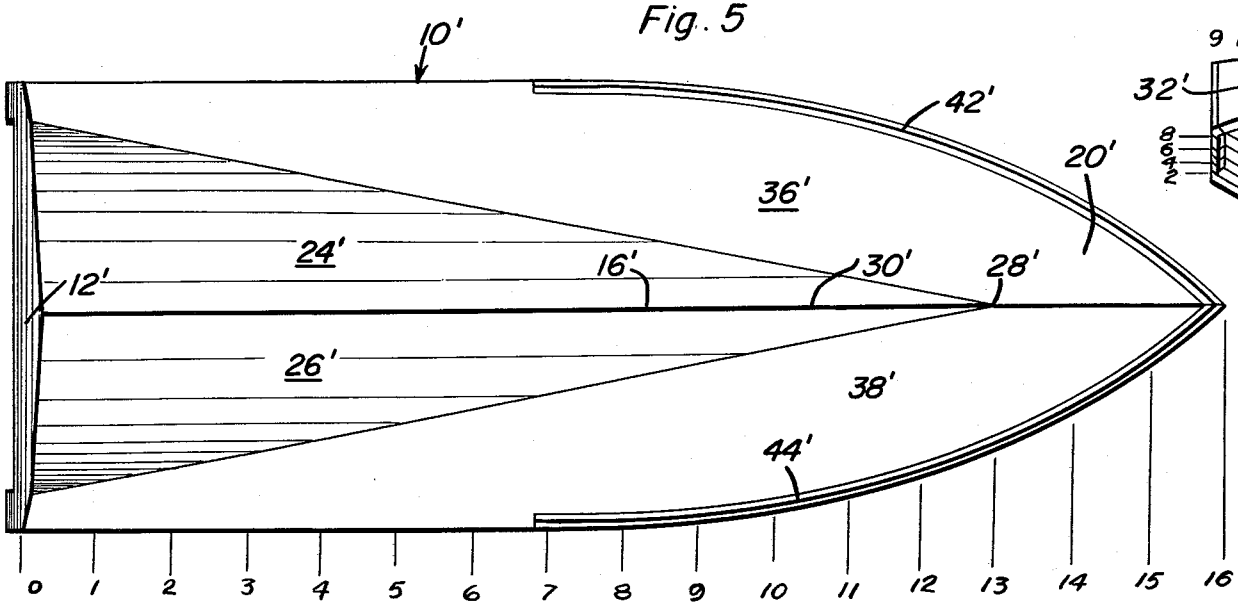
FIG. 5 is a bottom plan view of a second pointed bow form of hull constructed in accordance with the present invention.
Figure 2:
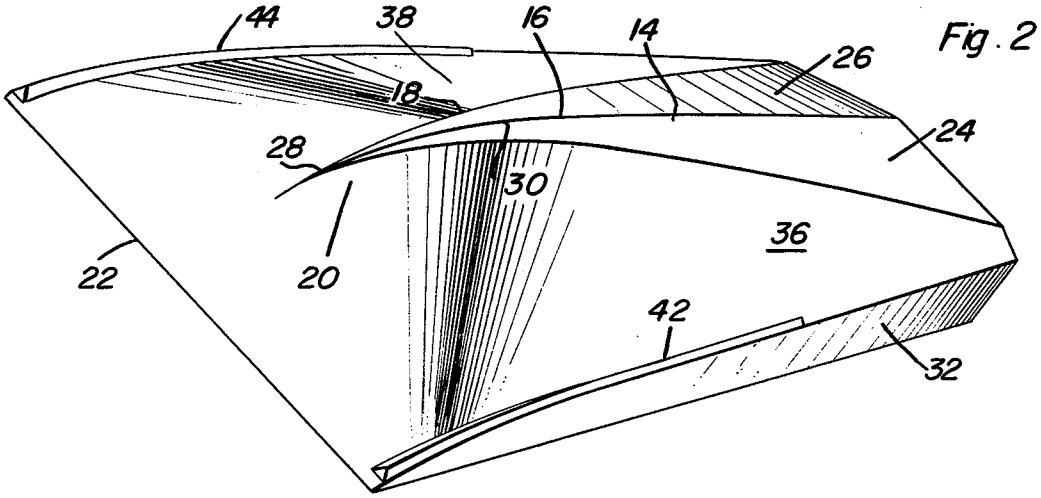
FIG. 2 is a perspective view of the underside of the hull illustrated in FIG. 1.

Referring now more specifically to FIGS. 5 through 7 a second form of hull including a pointed bow is referred to in general by the reference numeral 10'. The hull 10' is substantially identical to the hull 10, except that the hull 10' includes a pointed bow. Accordingly, the various components of the hull 10' corresponding to similar components of the hull 10 are designated by corresponding prime reference numerals.

From FIG. 7 of the drawings it may be seen that the forward upwardly curving outer bottom surfaces 36' and 38', forward of the point 16', are angled relative to transverse horizontal lines slightly more than the corresponding portions of the surfaces 36 and 38. However, other than this difference and the fact that the bow 20' of the hull 10' is pointed rather than square the hull 10' is substantially identical to the hull 10.

In comparing FIGS. 1 and 5 of the hulls 10 and 10' it will be noted that the deadrise or planing surfaces 24, 24' and 26, 26' decrease appreciably in width forwardly toward points 16 and 16' from the transom 12 and 12'. Accordingly, the deadrise surfaces are operable to sustain appreciable less lift at below planing speeds with the result that the bows 20 and 20' do not rise excessively during low speed operation. Further, inasmuch as the forward upwardly curving extremities of the deadrise surfaces 24, 24' and 26, 26' are relatively narrow forward of the points 16 and 16' the hulls 10 and 10' do not pound while moving at high speeds over rough waters. Still further, the deadrise angle at the bows of the hulls 10 and 10' is relatively shallow. Accordingly, there is little tendency for either of the hulls 10 and 10' to broach under conditions which tend to cause broaching. Also, from FIGS. 3, 4 and 7 it may be seen that the transverse contours of the wetted bottom surfaces offer substantially no surfaces or edges which would cause the hulls 10 and 10' to trip during high speed turns. Still further, while the outer bottom surfaces 36, 36' and 38, 38' rearward of the points 16 and 16' are angled between 30° and 45° relative to a transverse horizontal line, the corresponding portions of the surfaces 24, 24' and 26, 26' are inclined between 10° and 25° relative to horizontal transverse lines. Thus, the hulls 10 and 10' are capable of executing high speed turns without wedging the aft bottom surfaces thereof down into the water.

It will be noted from FIGS. 3 and 7 that the angle of the outer bottom surfaces 36, 36' and 38, 38' remains substantially constant from the transoms 12 and 12' forward to the points 16 and 16' and is greater than the angle of the corresponding deadrise surfaces 24, 24' and 26, 26'. Further, from FIGS. 1 and 5 of the drawings it will no noted that the width of the deadrise or planing bottom surfaces 24, 24' and 26, 26' is relatively narrow at amidships. Thus, the hulls 10 and 10' may dig into the water more efficiently during high speed sharp turns to prevent skidding.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A non-broaching boat hull including an aft transom and upstanding freeboard sides extending forwardly from said transom and terminating in a forward bow, a bottom structure including a central keel defining a substantially straight rear portion extending horizontally forwardly from said transom to a point forward of amidship and merging smoothly, at its forward end portion, into an upwardly curving forward portion to form said forward bow, said bottom structure including opposite side deadrise surfaces extending outwardly from said keel, said deadrise surfaces including forwardly tapering substantially planar rear portions extending forwardly from said transom to an area adjacent said point and merging smoothly into upwardly curving forward end portions tapering in width to a forward apex defined by the forward extremities thereof forward of said point and curving upwardly into the lower portion of said bow, the angle of said deadrise surfaces relative to transverse horizontal lines not increasing from said transom to said apex, and upwardly and outwardly inclined opposite side outer bottom surfaces including substantially planar rear sections extending forwardly from said transom between the remote marginal portions of said deadrise surfaces and the lower marginal portions of said freeboard sides, said outer bottom surface rear sections increasing in width at least from said transom to the lowermost point of said upwardly curving bow and merging smoothly into forwardly and upwardly curving outer bottom surface forward sections, the angle of said outer bottom surface rear sections relative to transverse horizontal lines remaining at least substantially constant and substantially less than 90° relative to a vertical plane from said transom toward said bow, but being at least slightly greater than the angles of corresponding portions of said deadrise surfaces.

2. The combination of claim 1 wherein said outer bottom surface forward sections converge to each other and maintain substantially the same angle relative to horizontal transverse lines from said apex to the forward extremity of said bow, said upstanding freeboard sides curving inwardly toward each other from a point spaced rearward of said apex forward to said bow.

3. The combination of claim 1 wherein said deadrise surfaces are upwardly and outwardly inclined between 10 and 25 degrees relative to the horizontal.

4. The combination of claim 1 wherein said outer bottom surfaces, rearward of said lowermost point of said bow, are upwardly and outwardly inclined between 30° and 45° relative to the horizontal.

5. The combination of claim 4 wherein said deadrise surfaces are upwardly and outwardly inclined between 10° and 25° relative to the horizontal.

6. The combination of claim 5 wherein said outer bottom surface forward sections converge to each other and maintain substantially the same angle relative to horizontal transverse lines from said apex to the forward extremity of said bow, said upstanding freeboard sides curving inwardly toward each other from a point spaced rearward of said apex forward to said bow.

7. The combination of claim 1 including a depending spray deflector rail extending along the lower marginal portions of said freeboard sides forwardly of said lowermost point of said bow.

8. The combination of claim 1 wherein the angle of said deadrise surfaces decreases from said point toward said apex.

9. A boat hull including an aft transom and a bottom structure including a central keel defining a substantially straight rear portion extending horizontally forwardly from said transom to a point forward of amidship and merging smoothly, at its forward end portion, into an upwardly curving forward portion to form a forward bow, said bottom structure including opposite side deadrise surfaces extending outwardly from said keel, said deadrise surfaces including forwardly tapering substantially planar rear portions extending forwardly from said transom to an area adjacent said point and merging smoothly into upwardly curving forward end portions tapering in width toward said bow, the angle of said deadrise surfaces relative to transverse horizontal lines at least substantially not increasing from said transom to the forward extremities thereof, and upwardly and outwardly inclined generally planar opposite side outer bottom surface portions extending outwardly from the remote marginal portions of said deadrise surfaces and forwardly from said transom to an area adjacent said point, the angle of said outer bottom surfaces relative to transverse horizontal lines remaining at least substantially less than 90° relative to a vertical plane from said transom toward said bow, but being at least slightly greater than the angles of corresponding portions of said deadrise surfaces.

10. The combination of claim 9 wherein said deadrise surfaces decrease in width to a forward apex defined by the forward extremities thereof.

11. The combination of claim 10 wherein said outer bottom surface portions include forward sections extending forwardly from said area and curving upwardly to form said bow, said outer bottom surface forward sections being gradually reduced in angulation relative to horizontal transverse lines from a point spaced rearward of said apex forward to said bow, said upstanding freeboard sides generally paralleling said keel throughout at least substantially their entire extent forwardly of said point.

12. The combination of claim 9 wherein the said deadrise surfaces include forward end portions which curve upwardly into the lower portion of said bow.

13. The combination of claim 11 wherein said deadrise surfaces decrease in width to a forward apex defined by the forward extremities thereof.

* * * * *